US007018011B2

(12) United States Patent
Youn

(10) Patent No.: US 7,018,011 B2
(45) Date of Patent: Mar. 28, 2006

(54) PUMP APPARATUS FOR INK JET PRINTER

(75) Inventor: Karp-sik Youn, Gyunggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 169 days.

(21) Appl. No.: 10/730,126

(22) Filed: Dec. 9, 2003

(65) Prior Publication Data

US 2004/0119794 A1 Jun. 24, 2004

(30) Foreign Application Priority Data

Dec. 24, 2002 (KR) ..... 10-2002-0083522

(51) Int. Cl.
*B41J 2/165* (2006.01)

(52) U.S. Cl. ..... 347/30

(58) Field of Classification Search ..... 347/29, 347/30, 32; 417/477.1, 477.5
See application file for complete search history.

(56) References Cited

U.S. PATENT DOCUMENTS

| | | | | |
|---|---|---|---|---|
| 4,853,717 | A * | 8/1989 | Harmon et al. | 347/29 |
| 5,309,180 | A * | 5/1994 | Uchida | 347/30 |
| 5,898,444 | A * | 4/1999 | Kobayashi et al. | 347/29 |
| 5,910,808 | A * | 6/1999 | Fukasawa et al. | 347/30 |
| 6,364,449 | B1 * | 4/2002 | Takahashi et al. | 347/30 |
| 6,523,931 | B1 * | 2/2003 | Cipolla et al. | 347/30 |

* cited by examiner

*Primary Examiner*—Anh T.N. Vo
(74) *Attorney, Agent, or Firm*—Staas & Halsey LLP

(57) ABSTRACT

A pump for an inkjet printer applying a negative pressure to an inkjet head nozzle, includes: a tube connected to the inkjet head nozzle and being U-shaped; a plurality of rollers which contact an inner arch of the tube and having a tapered shape; and a rotor to which the plurality of rollers are rotatably mounted. When the rotor rotates in a direction, at least one of the plurality of rollers rotate and squeeze the tube. When the rotor stops rotating, the plurality of rollers return to a state in which the plurality of rollers do not squeeze the tube due to a recovering force of the tube. The squeezing of the tube generates the negative pressure in the inkjet head nozzle.

19 Claims, 10 Drawing Sheets

PUMP APPARATUS FOR INK JET PRINTER

CROSS-REFERENCE TO RELATED APPLICATIONS

This application claims the benefit of Korean Application No. 2002-83522, filed Dec. 24, 2002, in the Korean Intellectual Property Office, the disclosure of which is incorporated herein by reference.

BACKGROUND OF THE INVENTION

1. Field of the Invention

The present invention relates to a pump for an inkjet printer, and more particularly, to a pump for an inkjet printer which squeeze a tube to generate a suction force, thereby sucking ink from an inkjet head nozzle.

2. Description of the Related Art

An inkjet printer using a permanent head, which can be permanently used and refilled (replenished) with ink, and a semi-permanent head, generally includes a pump. The pump for the inkjet printer performs a sucking operation in order to remove air that may enter during the replenishing of the ink and to open a head nozzle when the head nozzle is blocked by dried ink.

Pumps used in inkjet printers are generally divided into piston type pump apparatuses and rotor type pump apparatuses. The rotor type is more commonly used. The rotor type utilizes the rotation of a rotor to squeeze a plastic tube and thus generate a pressure difference which causes ink to be ejected from an inkjet head nozzle.

Several inventions relating to such a rotor type pump apparatus have been patented and have been put to practical use, one example of which is disclosed in U.S. Pat. No. 5,910,808. Operation of that pump apparatus as disclosed will be briefly described with reference to FIG. 1.

As a rotor of the pump apparatus rotates in a counterclockwise direction, a roller 14 squeezes a tube 10. Due to a pressure difference to an atmosphere pressure occurring as the tube 10 is squeezed, the squeezing results in a negative pressure differential relative to the ambient. This negative pressure differential causes ink in an inkjet head nozzle (not shown) to be sucked into the tube 10 an end of which is connected to the inkjet head nozzle.

After the suction of the ink, when the rotor rotates in a clockwise direction, the roller 14 comes into contact with a damper plate 16 made of rubber as shown in FIG. 2. This contact moves the roller inward along a cam groove 12. In this state, the roller 14 does not squeeze the tube 10 so as to allow the tube 10 to return to its original (i.e. uncompressed) state. That is, the conventional rotor type pump apparatus varies the position of the roller 14 within the cam groove 12 by using the damper plate 16 when the rotor is rotated in the counterclockwise and the clockwise directions, whereby the tube 10 is squeezed and relaxed and thus the sucking operation is performed.

However, since in the conventional rotor type pump apparatus the position of the roller 14 is changed within the cam groove 12 by using the rubber-made damper plate 16 when the tube 10 is contracted and relaxed, the damper plate 16 is periodically subjected to an alternate shock load. Accordingly, when the pump apparatus is used for a long time, the properties of the rubber-made damper plate 16 such as elasticity and surface friction coefficient are deteriorated and thus reliability of the sucking operation is reduced.

Also, the collision of the roller 14 with the damper plate 16 when the damper plate 16 changes the position of the roller 14 in the cam groove 12 causes noise. When the tube 10 is disposed on a right-angled wall, the rotation of the roller 14 causes the tube 10 to ascend.

Still further, since the conventional pump apparatus requires many parts such as a plurality of gears, the damper plate, and the like manufacture and/or assembly can be complicated.

SUMMARY OF THE INVENTION

The present invention has been developed in order to solve the above problems in the related art. Accordingly, an aspect of the present invention is to provide a pump apparatus for an inkjet printer capable of preventing a reliability of sucking operation from being lessened even in the case that it is used for a long time.

Also, another aspect of the present invention is to provide a pump apparatus for an inkjet printer capable of preventing a collision noise from occurring during the rotation of a roller and a tube from ascending.

Also, still another aspect of the present invention is to provide a pump apparatus for an inkjet printer providing an effect that the number of parts can be decreased.

Additional aspects and/or advantages of the invention will be set forth in part in the description which follows and, in part, will be obvious from the description, or may be learned by practice of the invention.

According to an aspect of the present invention there is providing a pump for an inkjet printer applying a negative pressure to an inkjet head nozzle, including: a tube connected to the inkjet head nozzle and being U-shaped; a plurality of rollers which contact an inner arch of the tube and having a tapered shape; and a rotor to which the plurality of rollers are rotatably mounted. When the rotor rotates in a direction, at least one of the plurality of rollers rotate and squeeze the tube. When the rotor stops rotating, the plurality of rollers return to a state in which the plurality of rollers do not squeeze the tube due to a recovering force of the tube. The squeezing of the tube generates the negative pressure in the inkjet head nozzle.

The plurality of rollers may be tapered. Also, the plurality of rollers may be a pair of rollers disposed symmetrically to each other.

According to another aspect of the present invention there is a pump for an inkjet printer applying a negative pressure to an inkjet head nozzle, including: a fixing shaft; a driving gear rotatably assembled to the fixing shaft; a stopper protruding from a side of the driving gear; a ratchet wheel rotatably assembled to the fixing shaft, having a driving ratchet formed in a lower end thereof and a cam recess; a rotor assembled to the fixing shaft, movable in an axial direction, and having a driven ratchet formed in an upper end thereof which is engagable with the driving ratchet; a plurality of rollers rotatably disposed at the rotor and having tapered sides; and a tube disposed to contact the plurality of rollers and connected to the inkjet head nozzle. The driving gear is rotatable in a direction and rotation of the driving gear causes the rotor to move along the fixing shaft so that at least one of the plurality of rollers squeezes the tube.

When the driving gear stops rotating or is rotated in the reverse direction, the rotor may move along the driving shaft in a reverse direction due to a recovering force of the tube to return the tube to an original state.

The plurality of rollers a pair of rollers disposed symmetrically to each other.

The tube may be disposed in a housing accommodating the rotor, the ratchet wheel and the driving gear, and the housing may be provided with a rotor stopper protruding from an inner side thereof which encourages the plurality of rollers to maintain contact with the tube when the rotor is not rotating.

The driving ratchet and the driven ratchet may be inclined and cooperate so that a load of the plurality of rollers applied to the tube by the driving ratchet when the ratchet wheel rotates in a reverse direction opposite the direction is smaller than the recovering force of the tube.

According to still another aspect, there is provided a pump which pumps ink from an ink source, including: a shaft; a driving gear surrounding the shaft and rotatable in a direction about the shaft; a stopper integrally formed on a side of the driving gear and having at least one protrusion; a ratchet rotatable about the shaft, movable about an axial direction, having one or more cam recesses formed on an upper side each of which receive a projection, and having a driving ratchet formed at a lower side; a rotor rotatable about the fixing shaft, movable about an axial direction, and having a driven ratchet formed on an upper side; and two or more rollers extending from a lower side of the rotor and which orbit the shaft when the rotor rotates.

Also, according to the pump apparatus of the present invention, the collision noise does not occur during the operation, and the tube is prevented from ascending over the rollers.

Also, according to the pump apparatus of the present invention, the number of the components of the apparatus can be reduced.

BRIEF DESCRIPTION OF THE DRAWINGS

The above aspects and/or other advantages of the present invention will be more apparent by describing a preferred embodiment of the present invention, in which.

DETAILED DESCRIPTION OF THE PREFERRED EMBODIMENTS

Figure 1:
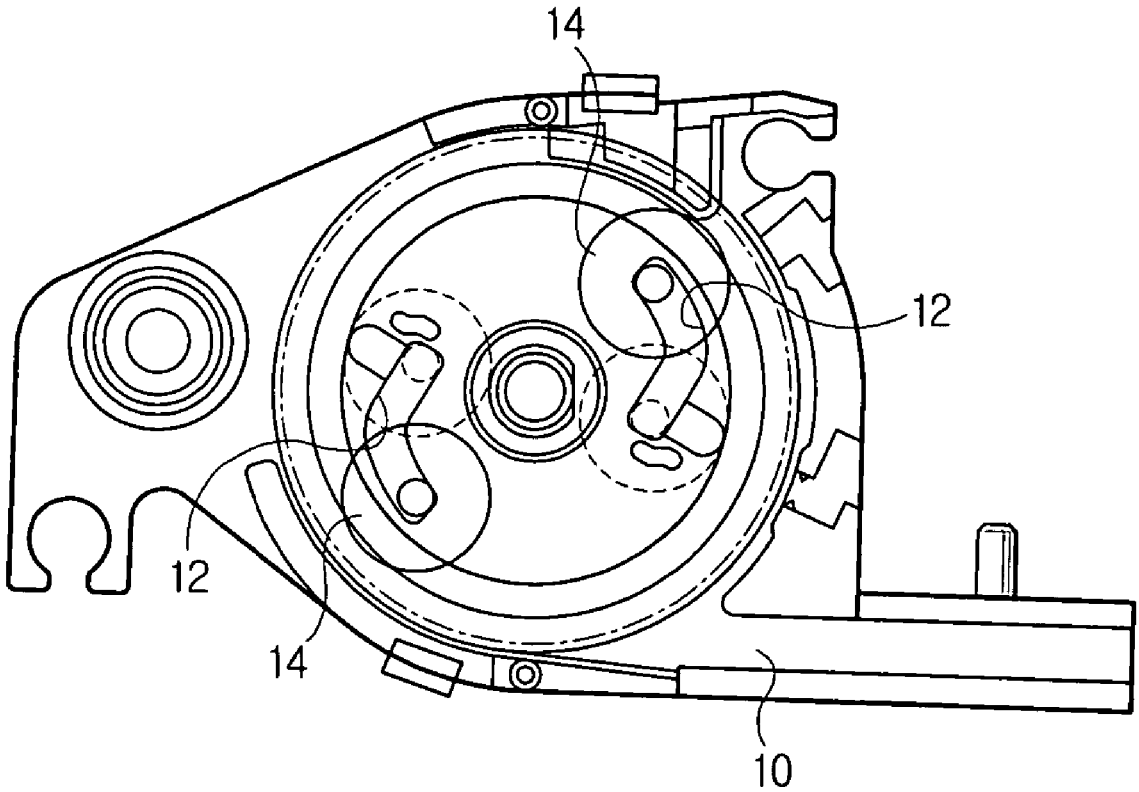
FIG. 1 (PRIOR ART)
FIG. 1 is a cross-sectional view showing a conventional pump apparatus for an inkjet printer.
Figure 2:
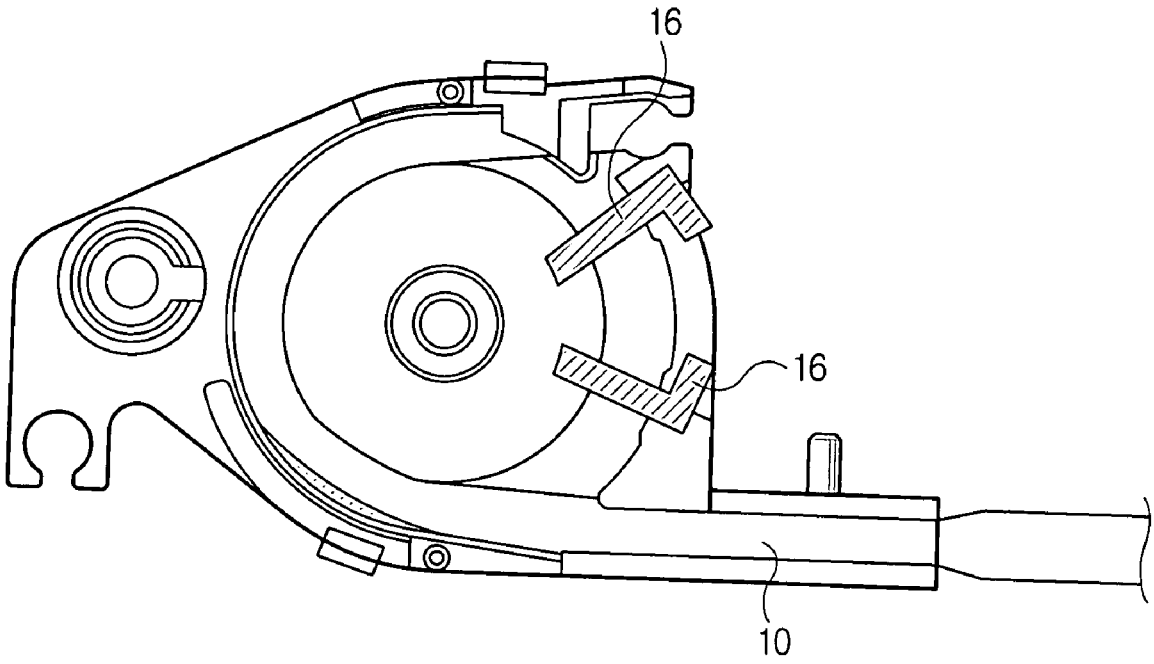
FIG. 2 (PRIOR ART)
FIG. 2 is a cross-sectional view showing the damper plate of the pump apparatus for the inkjet printer of FIG. 1.
Figure 3:
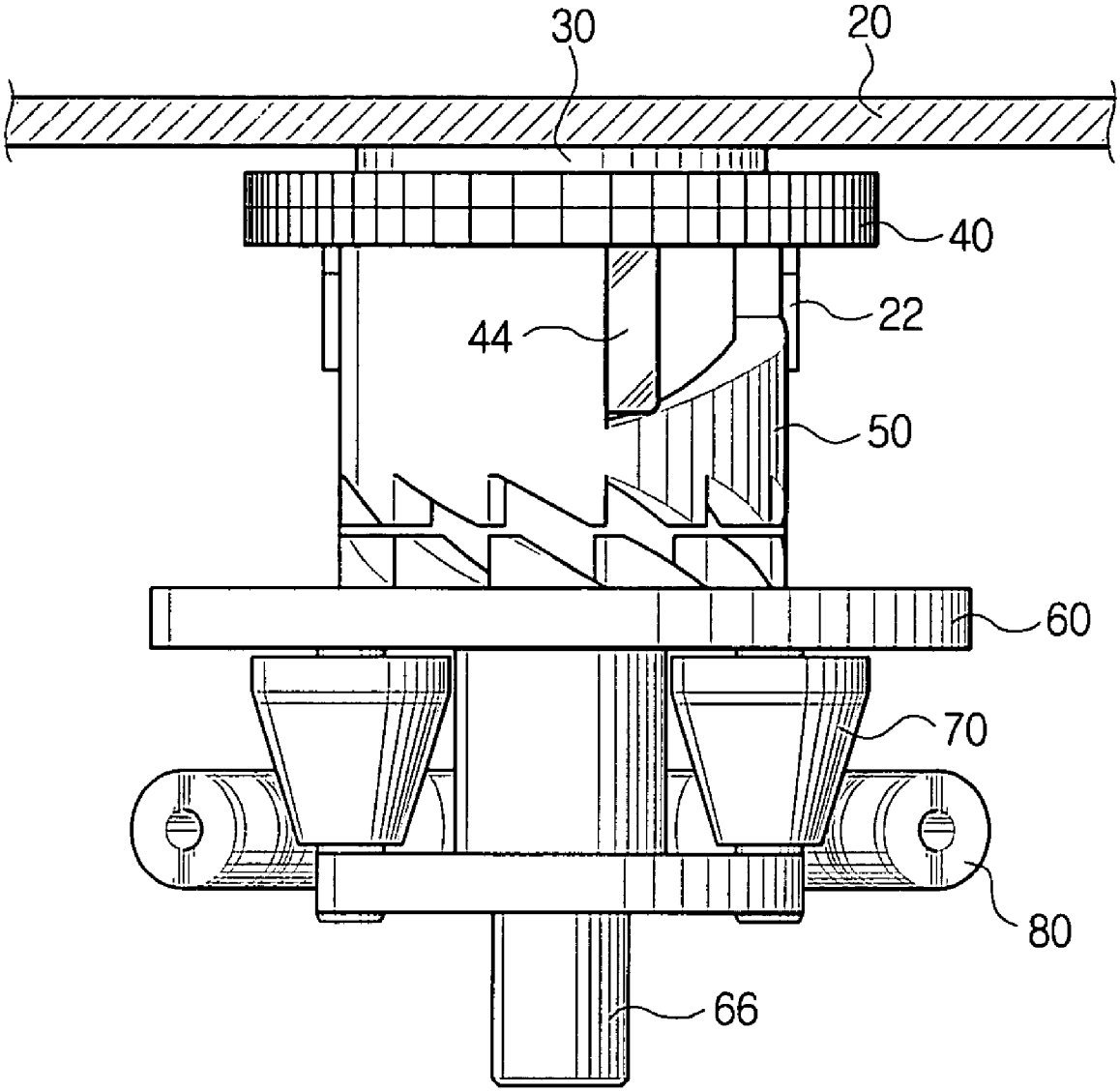
FIG. 3 is a perspective view showing a pump apparatus for an inkjet printer according to a first embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, a pump apparatus for an inkjet printer according to an embodiment of the present invention will be described with reference to the accompanying drawings.

Referring concurrently to FIGS. 3 to 6, the pump apparatus for the inkjet printer according to a first embodiment of the present invention includes a fixing shaft 30, a driving gear 40, a ratchet wheel 50, a rotor 60, a tube 80, and a housing 90.

The fixing shaft 30 is fixed to a frame 20 of the inkjet printer in which the pump apparatus is disposed, and guides the rotation of the driving gear 40 and the rotor 60.

Figure 5:
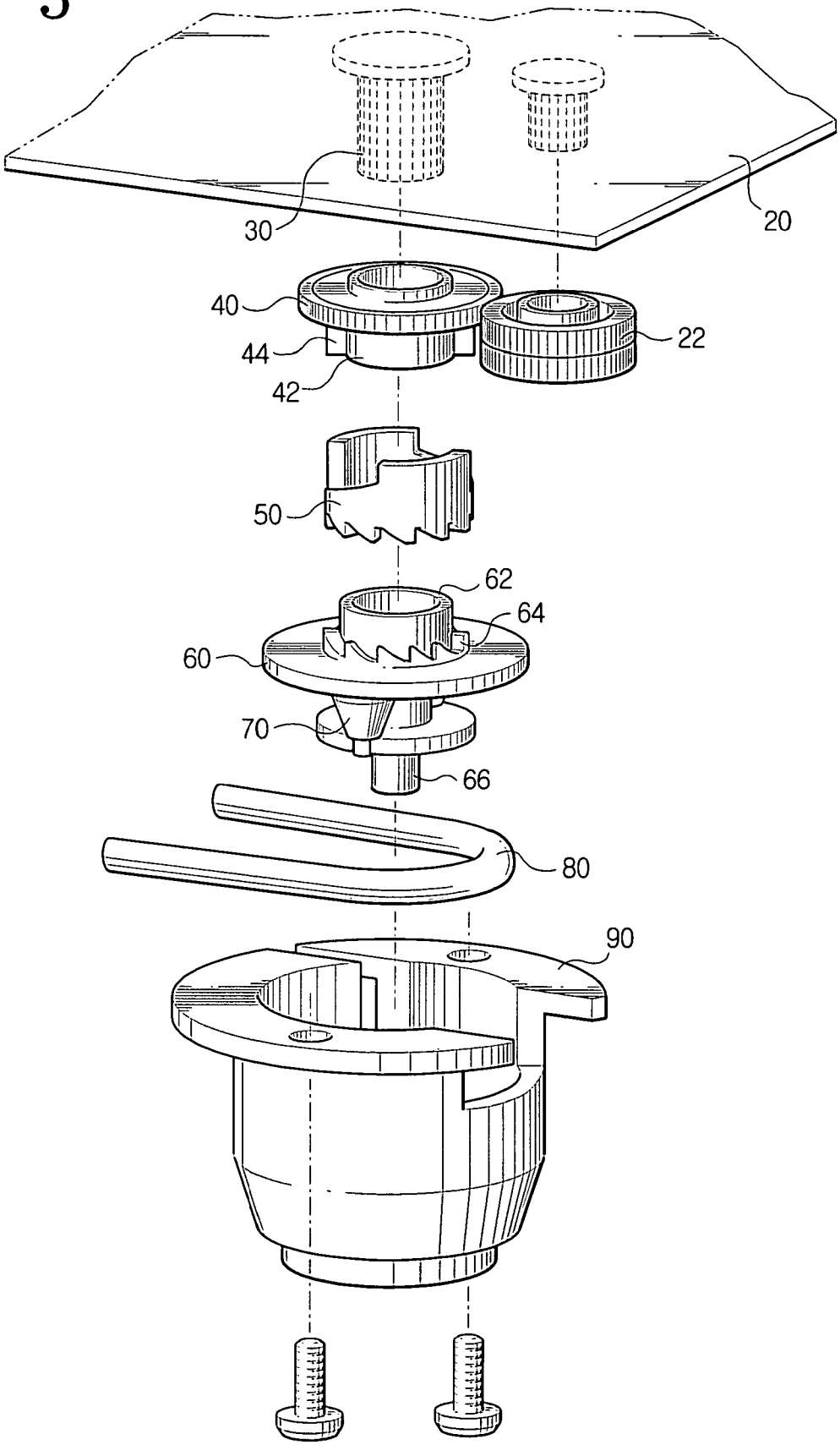
FIG. 5 is an exploded perspective view showing the pump apparatus for the inkjet printer of FIG. 4.

FIG. 5 shows that the driving gear 40 is rotatably disposed on the fixing shaft 30 and engaged with a driving force transmitting gear 22 for transmitting a driving force from a motor (not shown). A stopper 42 protrudes from one end of the driving gear 40. The stopper 42 is formed in a hollow shape to be assembled with the fixing shaft 30 and has a projection 44 protruding from a sidewall thereof. The stopper includes two projections 44. However, while two projections are shown and described, more projections may be provided and, when multiple projections 44 are provided in pair, they are symmetrically disposed to each other as shown in FIG. 5 for smooth operation.

Figure 6:
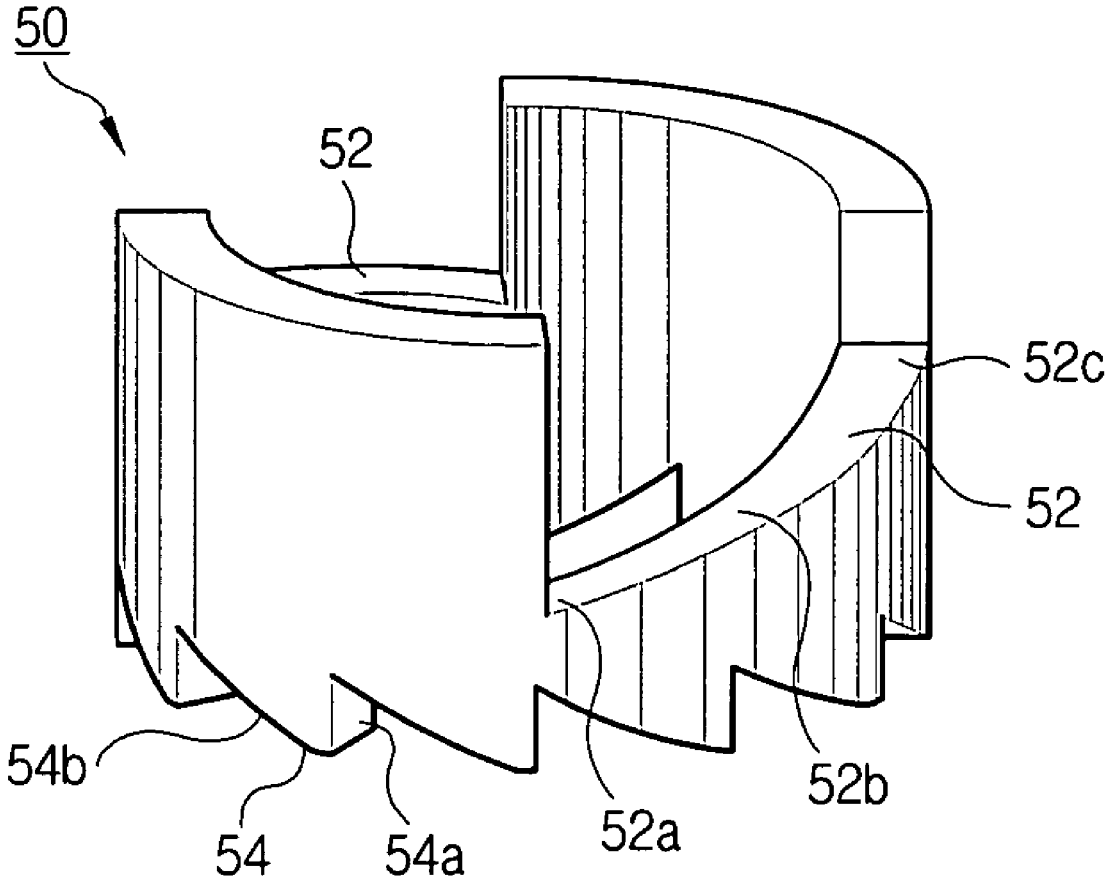
FIG. 6 is a perspective view showing the ratchet wheel of the pump apparatus for the inkjet printer of FIG. 4.

The ratchet wheel 50 is hollow-shaped as shown in FIG. 6 and has a driving ratchet 54 at one end thereof (the upper end in FIG. 6) and a cam recess 52 at the other end (the lower end in FIG. 6) thereof. The ratchet wheel 50 has an inner diameter sufficient to smoothly rotate with respect to an outer diameter of the stopper 42. The cam recess 52 is defined in a circumference of the lower end of the ratchet wheel 50 and has a bottom gradually inclined from one side 52*a* to the other side 52*c*. The projection 44 of the stopper 42 is inserted into the cam recess 52 and the rotation of the stopper 42 causes the bottom of the cam recess 52 to be pushed, so that the ratchet wheel 50 moves in a lengthwise direction on the stopper 42. When the projection 44 is positioned at side 52*a* of the cam recess 52, the driving ratchet 54 is disengaged from the driven ratchet 64 so that the roller 70 does not squeeze the tube 80. On the other hand, when the projection 44 is positioned at the other side 52*c* of the cam recess 52, the driving ratchet 54 is engaged with the driven ratchet 64 so that the roller 70 squeezes the tube 80. When the projection 44 is positioned at the other side 52*a* of the cam recess 52, the driving ratchet 54 is not in contact with the driven ratchet 64. That is, the lower surface of the driving ratchet 54 and the upper surface of the driven ratchet 64 are spaced apart by a gap so that the driving ratchet 54 avoids coming into contact with the driven ratchet 64. The rotor 60 rises due to a recovering force of the squeezed tube 80 on the non-operation of the driving gear 40, causing the ratchet wheel 50 to be rotated in the reverse direction. The gap is to prevent the reverse rotation of the rotor 60 caused by the reverse rotation of the ratchet wheel 50. The reverse rotation of the rotor 60 may causes a noise and abrasion.

The driving ratchet 54 is formed of a series of triangular teeth with one side 54*a* being right-angled to a parallel line and disposed along the circumference of one end of the ratchet wheel 50. An inclined surface 54*b* of the driving ratchet 54 is formed in a manner so that it allows the ratchet wheel 50 to move in a lengthwise direction of the stopper 42 as the rotor 60 moves upwardly due to a recovering force of the tube 80 on the non-operation of the driving gear 40 and thus the driven ratchet 64 pushes the driving ratchet 54. Also, the inclined surface 54*b* of the driving ratchet 54 is formed in a manner so that when the driving gear 40 rotates in a direction that it does not squeeze the tube 80, a force the driving ratchet 54 applies to the driven ratchet 64 is not greater than a force applied to the driven gear 64 due to the recovering force of the tube 80.

Turning back to FIG. 5, the rotor 60 is shaped as a hollow cylinder and one end 62 thereof moves in an axial direction with respect to the fixing shaft 30. Around an outer circumference of the hollow cylinder is formed the driven ratchet 64 to be engaged with the driving ratchet 54. At the other end of the rotor 60 are provided two rollers 70. The two rollers 70 are tapered, orbit the rotor 60 as it rotates, and freely and independently rotate with respect to the rotor 60. However, while two rollers are shown and described, it is to be understood that more than two rollers may be provided. A tapered portion of the roller 70 completely squeezes the tube 80 as the rotor 60 is moved to the maximum degree by the stopper 42. Also, the size of the driven ratchet 64 is identical to that of the driving ratchet 54. At a center portion of the other end of the rotor 60 may be provided a guide shaft 66 for supporting the rotation of the rollers 70 and guiding the straight forwarding movement of the rotor 60 with respect to the fixing shaft 30. One end of the guide shaft 66 is inserted into the housing 90 to guide the straight forwarding movement of the rotor 60.

The tube 80 is disposed at a position to come into contact with at least one of the rollers 70 that orbit as the rotor 60 rotates. Although not shown, one end of the tube 80 is connected to an inkjet head nozzle. Generally, the tube 80 is disposed around the rollers 70 to come into contact with one roller 70 in a half orbiting circle of the plural rollers 70. Accordingly, when the rotor 60 is rotated by the driving gear 40, only one roller 70 rotates, squeezing the tube 60. The tube 80 is made of material having a high elasticity so that it easily recovers its original state from a squeezed state. That is, the tube 80 has to have a recovering force powerful enough to push the rotor 60 and the ratchet wheel 50 toward the driving gear 40.

Figure 4:
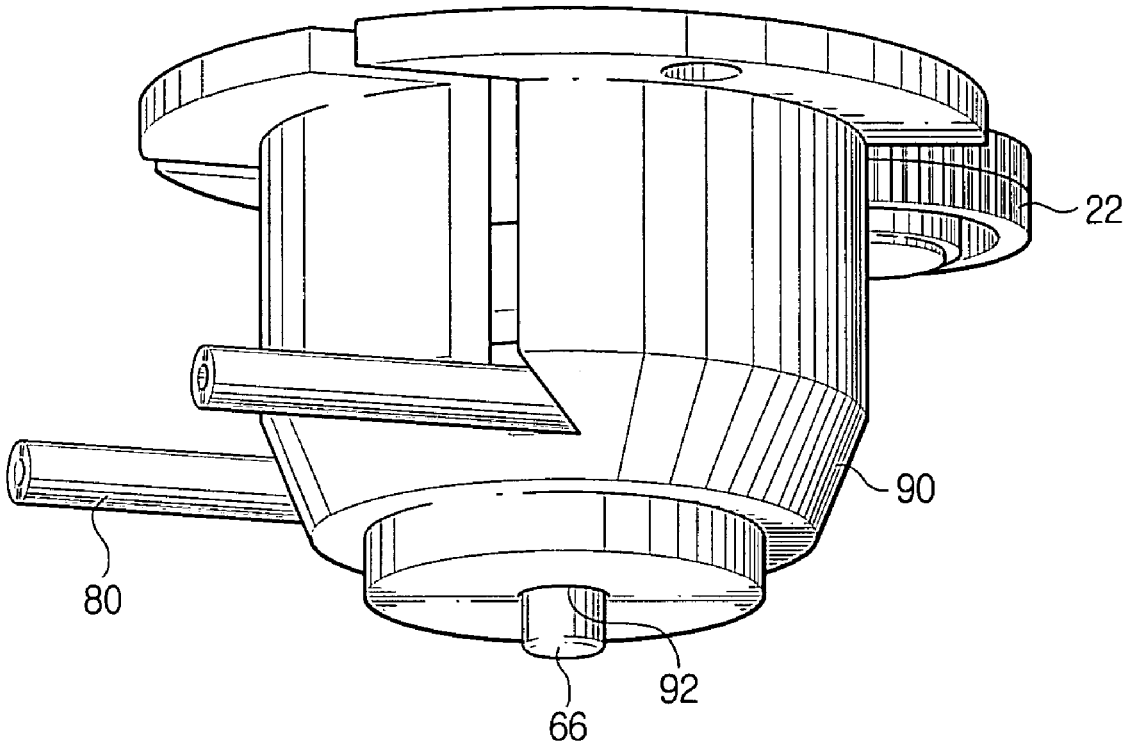
FIG. 4 is a perspective view showing the housing assembled with the pump apparatus for the inkjet printer of FIG. 3.
Figure 7:
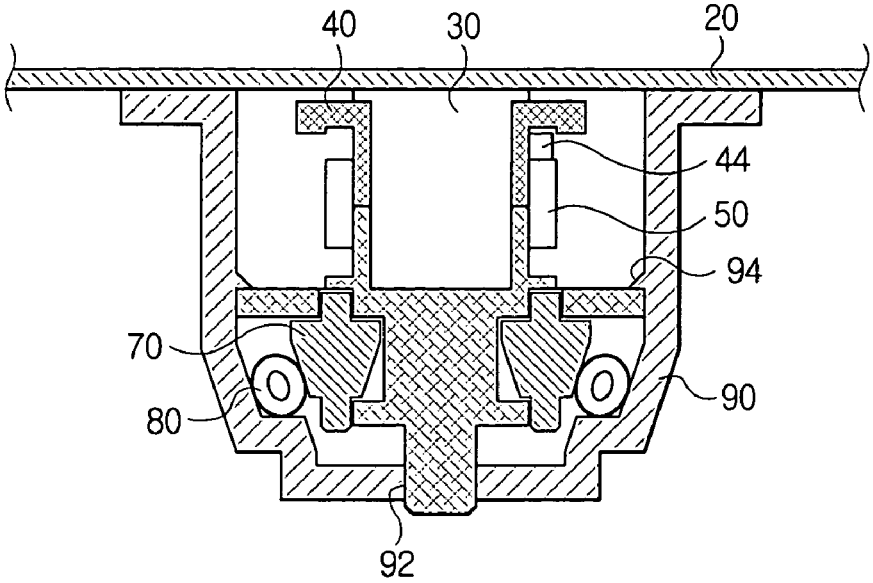
FIG. 7 is a cross sectional view showing the pump apparatus for the inkjet printer of FIG. 4 in the non-operation.

As FIG. 4 shows, the housing 90 accommodates the above-described components to prevent foreign materials from going into the pump apparatus, and especially firmly secures the tube 80 thereto. The housing 90 is provided with a guide hole 92 formed in one end thereof. Into the guide hole 92 is inserted the guide shaft 66 of the rotor 60. Also, the housing 90 is provided with a rotor stopper 94 (shown in FIG. 7) protruding from an inner side thereof. The rotor stopper 94 supports one end of the rotor 60 in order for the roller 70 to preload upon the tube 80 when the driving gear 40 is in the non-operation. The roller 70 preloads upon the tube 80 to prevent the rotor 60 from idle-rotating when the rotor 60 is rotated due to the ratchet wheel 50. Accordingly, the degree of preload is set to an extent so that the tube 80 is not squeezed so as to generate a negative pressure and a friction force is generated between the roller 70 and the tube 80 (shown in FIG. 7).

Hereinafter, operation of the pump apparatus for the inkjet printer according to an embodiment of the present invention will be described in detail with reference to FIGS. 7 to 9C.

Figure 8:
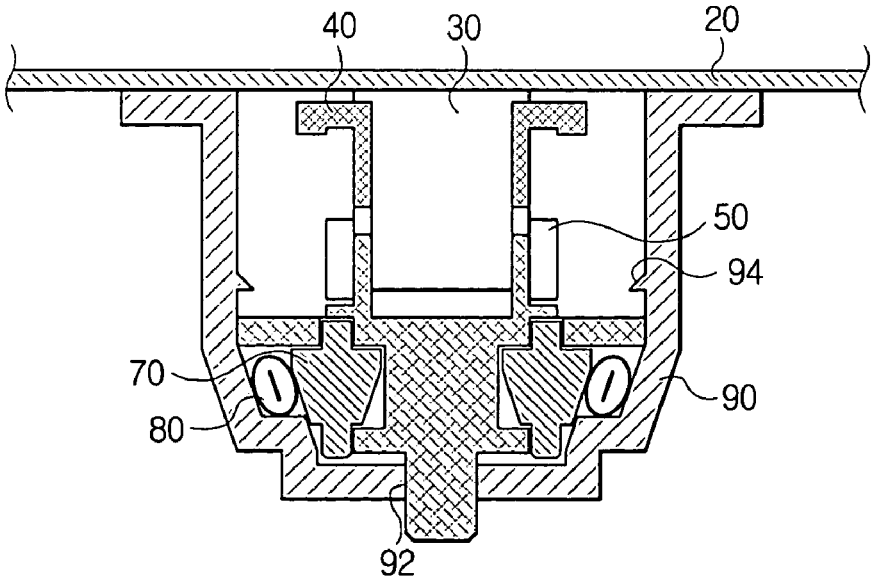
FIG. 8 is a cross sectional view showing the pump apparatus for the inkjet printer of FIG. 4 when it rotates in a direction of squeezing the tube.
Figure 9A:
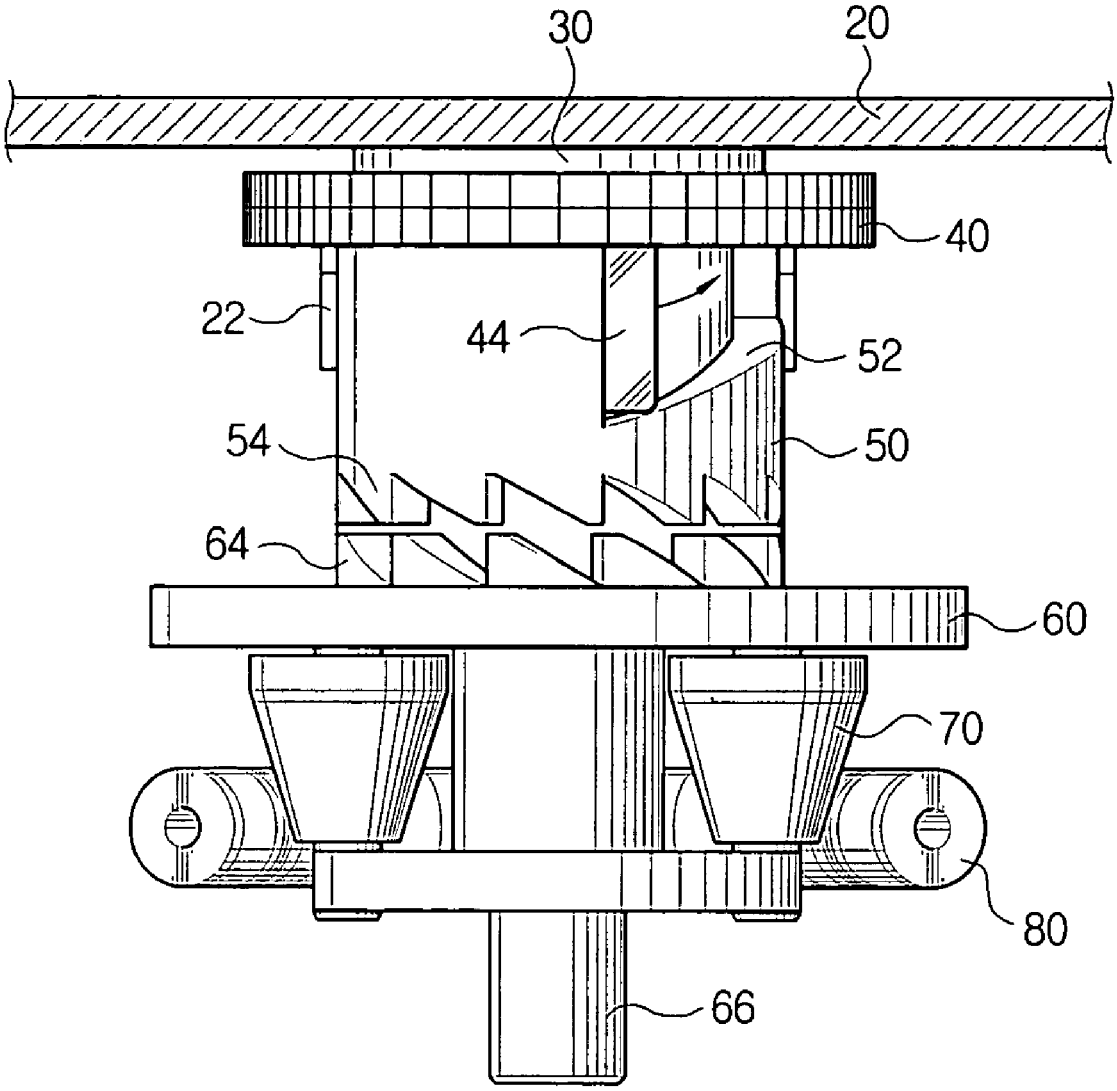
FIG. 9A is a perspective view showing the pump apparatus for the inkjet printer of FIG. 3 in a non-operational mode.
Figure 9B:
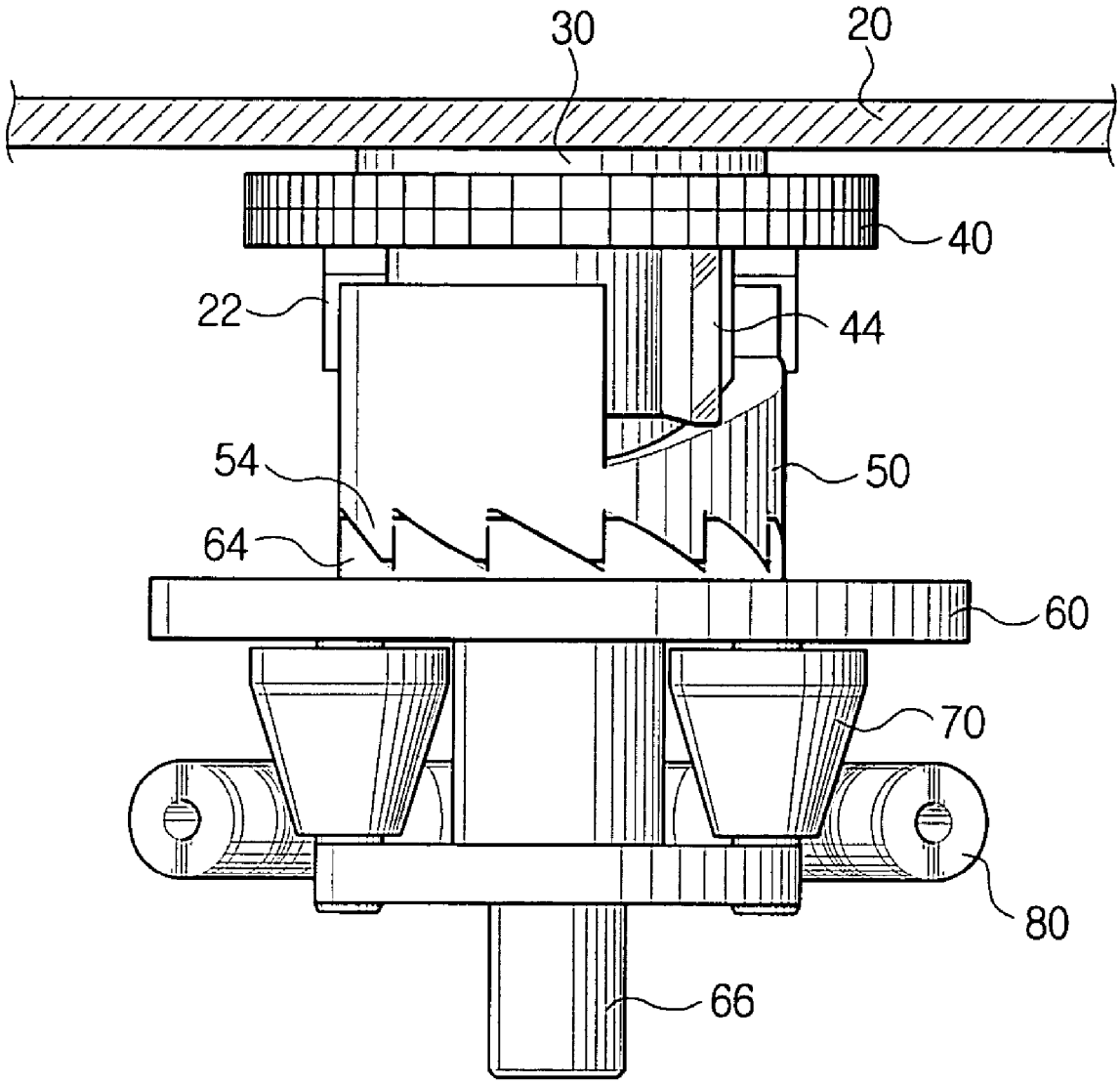
FIG. 9B is a perspective view showing the driving ratchet and the driven ratchet engaged with each other when the pump apparatus for the inkjet printer of FIG. 9A rotates.
Figure 9C:
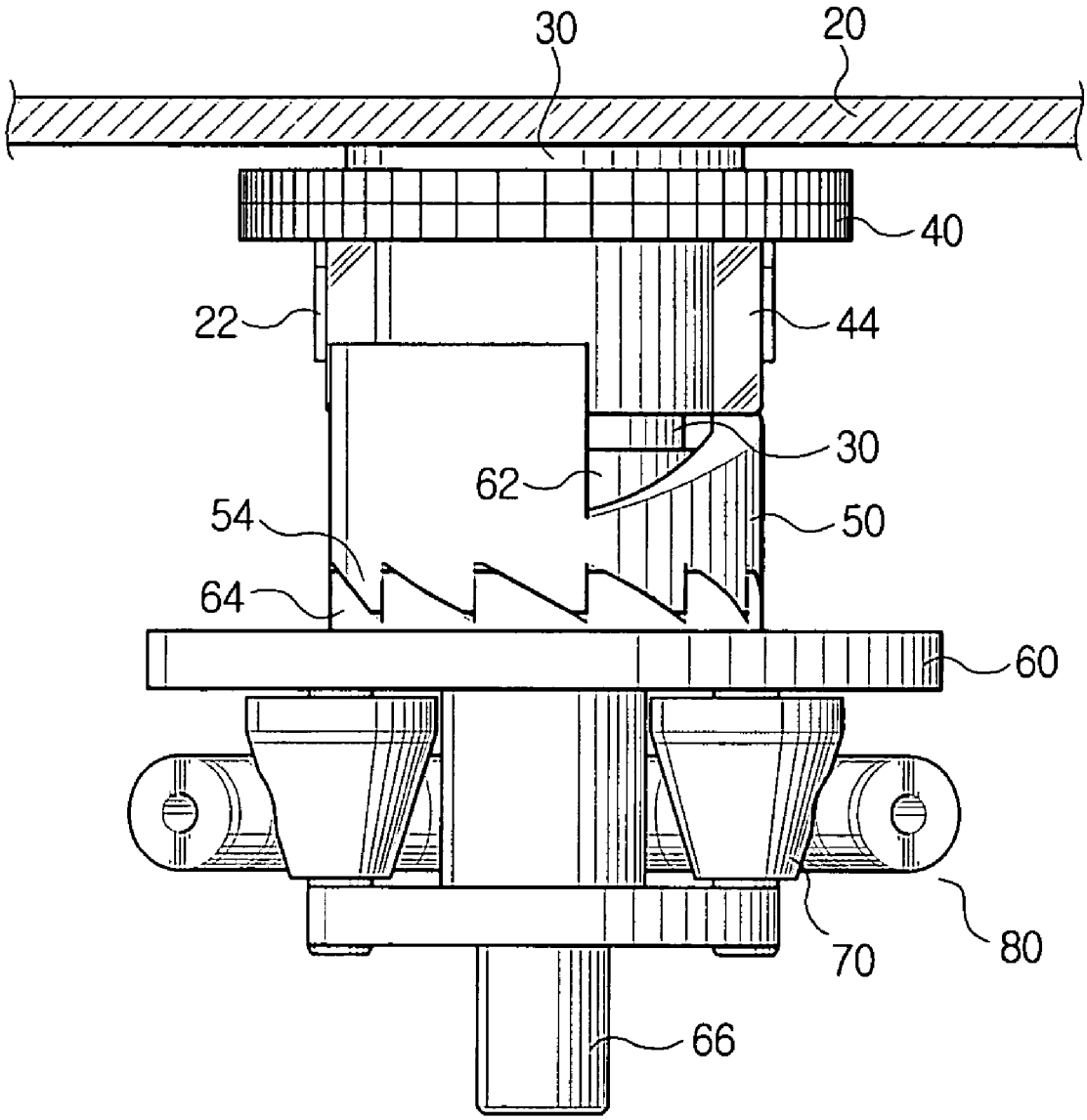
FIG. 9C is a perspective view showing the plurality of rollers squeezing the tube when the pump apparatus for the inkjet printer of FIG. 9A rotates further than the state of FIG. 9B.

When the driving force transmitting gear 22 (not shown) is rotated by the motor (not shown), the driving gear 40 surrounding the fixing shaft 30 is rotated in a direction on the fixing shaft 30. In conjunction with the rotation of the driving gear 40, the stopper 42 integrally formed with the driving gear 40 is rotated in the same direction. If the stopper 42 is rotated in a counterclockwise direction (an arrow direction of FIG. 9A), the ratchet wheel 50 is separated from the rotor 60 as shown in FIG. 9A is moved downwardly by the projection 44 of the stopper 42. When the projection 44 is moved to a position 52*b* of the cam recess 60 (shown in FIG. 6), the driving ratchet 54 of the ratchet 50 is engaged with the driven ratchet 64 of the rotor 60. If the rotation of the projection 44 continues, the ratchet wheel 50 and the rotor 60 are pushed downwardly so that the plural rollers 70 squeeze the tube 80. When the projection 44 reaches the other side 52*c* (shown in FIG. 6) of the cam recess 52, the tube 80 is completely squeezed by the roller 70 as shown in FIGS. 8 and 9C. That is, the inner diameter of the tube 80 is completely compressed. If the projection 44 continues to rotate, the ratchet wheel 50 is also rotated in association with the projection 44. The rotation of the ratchet wheel 50 causes the driven ratchet 64 engaged with the driving ratchet 54 of the ratchet wheel 50 to rotate. Accordingly, the rotor 60 is rotated so that the plural rollers 70 disposed at the rotor 60 orbit the rotor 60, squeezing the tube 80. The two rollers 70 are both initially pressing the tube 80. However, when the rotor 60 is rotated, one roller of the two rollers 70 is rotated, squeezing the tube 80, while the other one is rotated, about the rotor and away from a contact with the tube 80. While the rotor 60 rotates, one roller is moved from the contact with the tube 80 as the other roller comes into contact with the tube 80. Accordingly, as the rotation of the rotor 60 continues, the two rollers 70 rotate, alternately squeezing the tube 80. When the roller 70 squeezes the tube 80, there is generated a negative pressure in the tube 80. Due to the pressure difference between the negative pressure and an atmosphere pressure, the tube 80 performs sucking operation of ink from the inkjet head nozzle.

After the sucking operation, the motor stops operating and thus the driving force transmitting gear 22 stops rotating. Accordingly, the driving gear 40 stops rotating. When the driving gear 40 stops rotating, the rotor 60 is released from the load applied by the projection 44 of the stopper 42 disappears. Then, due to the recovering force of the tube 80, the tube 80 recovers its original state and pushes the rollers 70 upwardly. On receipt of the upward load, the rotor 60 is moved along the fixing shaft 40 in an axial direction. As the rotor 60 is moved upwardly, the driven ratchet 64 and the ratchet wheel 50 are concurrently moved upwardly to thus return to the initial state as shown in FIG. 9A. That is, when the driving gear 40 stops rotating, the rotor 60 and the ratchet wheel 50 are moved upwardly due to the recovering force of the tube 80, so that the tube 80 automatically recovers its original state in which it is not squeezed.

Alternatively, the motor is rotated in the reverse direction to move the ratchet wheel 50 and the rotor 60 upwardly, whereby the tube 80 returns to its original state. This embodiment requires the cam recess 52 of the ratchet wheel 50 to be modified so that when the stopper 42 is rotated in the reverse direction, the ratchet wheel 50 is upwardly moved.

As described above, since the pump apparatus for the inkjet printer according to the present invention does not require the damper plate, the reliability of the sucking operation is improved and the collision noise does not occur even in the case that the pump apparatus is used for a long time. Also, since the tapered rollers 70 is constantly in contact with the tube 80, the tube 80 is prevented from ascending over the rollers 70, and the number of the components can be reduced.

Although a few embodiments of the present invention have been shown and described, the present invention is not limited to the disclosed embodiments. Rather, it would be appreciated by those skilled in the art that changes and modifications may be made in this embodiment without departing from the principles and spirit of the invention, the scope of which is defined by the claims and their equivalents.

What is claimed is:

1. A pump for an inkjet printer applying a negative pressure to an inkjet head nozzle, comprising:

a driving gear surrounding a shaft and rotatable in a direction about the shaft and including a stopper integrally formed on a side of the driving gear and having at least one protrusion;

a ratchet rotatable about the shaft, movable about an axial direction, having one or more cam recesses formed on an upper side each of which receive the at least one protrusion, and having a driving ratchet formed at a lower side;

a tube connected to the inkjet head nozzle and being U-shaped;

a plurality of rollers which contact an inner arch of the tube and having a tapered shape; and a rotor to which the plurality of rollers are rotatably mounted, rotatable about the fixing shaft, movable about an axial direction, and having a driven ratchet formed on an upper side, wherein, when the rotor rotates in a direction, at least one of the plurality of rollers rotate and squeeze the tube, wherein, when the rotor stops rotating, the plurality of rollers return to a state in which the plurality of rollers do not squeeze the tube due to a recovering force of the tube, and wherein the squeezing of the tube generates the negative pressure in the inkjet head nozzle.

2. The pump of claim 1, wherein the plurality of rollers are tapered.

3. The pump of claim 2, wherein the plurality of rollers are a pair of rollers disposed symmetrically to each other.

4. A pump for an inkjet printer applying a negative pressure to an inkjet head nozzle, comprising:

a fixing shaft;

a driving gear rotatably assembled to the fixing shaft;

a stopper protruding from a side of the driving gear;

a ratchet wheel rotatably assembled to the fixing shaft, having a driving ratchet formed in a lower end thereof and a cam recess;

a rotor assembled to the fixing shaft, movable in an axial direction, and having a driven ratchet formed in an upper end thereof which is engagable with the driving ratchet;

a plurality of rollers rotatably disposed at the rotor and having tapered sides; and a tube disposed to contact the plurality of rollers and connected to the inkjet head nozzle, wherein the driving gear is rotatable in a direction and rotation of the driving gear causes the rotor to move along the fixing shaft so that at least one of the plurality of rollers squeezes the tube.

5. The pump of claim 4, wherein, when the driving gear stops rotating or is rotated in the reverse direction, the rotor moves along the driving shaft in a reverse direction due to a recovering force of the tube to return the tube to an original state.

6. The pump of claim 4, wherein the plurality of rollers are a pair of rollers disposed symmetrically to each other.

7. The pump of claim 4, wherein the tube is disposed in a housing accommodating the rotor, the ratchet wheel and the driving gear.

8. The pump of claim 7, wherein the housing is provided with a rotor stopper protruding from an inner side thereof which encourages the plurality of rollers to maintain contact with the tube when the rotor is not rotating.

9. The pump of claim 4, wherein the driving ratchet and the driven ratchet are inclined and cooperate so that a load of the plurality of rollers applied to the tube by the driving ratchet when the ratchet wheel rotates in a reverse direction opposite the direction is smaller than the recovering force of the tube.

10. A pump which pumps ink from an ink source, comprising:

a shaft;

a driving gear surrounding the shaft and rotatable in a direction about the shaft;

a stopper integrally formed on a side of the driving gear and having at least one protrusion;

a ratchet rotatable about the shaft, movable about an axial direction, having one or more cam recesses formed on an upper side each of which receive the at least one projection, and having a driving ratchet formed at a lower side;

a rotor rotatable about the fixing shaft, movable about an axial direction, and having a driven ratchet formed on an upper side; and two or more rollers extending from a lower side of the rotor and which orbit the shaft when the rotor rotates.

11. The pump of claim 10, wherein, when the driving gear rotates in the direction, the projection is received by the one or more cam recesses and the ratchet wheel is moved axially by the projection so that the driving ratchet engages the driven ratchet, wherein, when rotation of the projection continues after engagement of the ratchets, the ratchet wheel and the rotor move axially so that the plural rollers squeeze a tube.

wherein, when the projection continues to rotate after the plural rollers squeeze the tube, the ratchet wheel rotates in association with the projection and the rotor is rotated so that the plural rollers disposed at the rotor orbit the rotor, squeezing the tube.

12. The pump of claim 10, wherein the cam recess is inclined so that when a projection reaches a side of the cam recess, an inner diameter of the tube is completely compressed.

13. The pump of claim 10, wherein two rollers are both initially pressing the tube.

14. The pump of claim 10, wherein at least one roller is in contact with the tube.

15. The pump of claim 10, wherein, as the rotor rotates, the two or more rollers rotate and alternately squeeze the tube.

16. The pump of claim 10, wherein, when the driving gear stops rotating, the projection disengages from the cam wall, a recovering force of the tube pushes the rollers upwardly so as to axially move the rotor along the fixing shaft.

17. The pump of claim 10, wherein the two or more rollers are tapered.

18. The pump of claim 10, wherein the two or more rollers orbit the rotor when the rotor rotates.

19. The pump of claim 10, wherein the two or more rollers independently rotate with respect to the rotor.

* * * * *